United States Patent [19]

Goding et al.

[11] Patent Number: 4,841,873

[45] Date of Patent: Jun. 27, 1989

[54] RAILWAY LOCOMOTIVE AND STABILIZED SELF STEERING TRUCK THEREFOR

[75] Inventors: David J. Goding, Palos Park; Mostafa Rassaian, Westchester, both of Ill.

[73] Assignee: General Motors Corporation, Detroit, Mich.

[21] Appl. No.: 10,365

[22] Filed: Feb. 3, 1987

[51] Int. Cl.[4] ..... B61F 5/38

[52] U.S. Cl. ..... 105/168; 105/175.1; 105/182.1

[58] Field of Search ..... 105/165, 167, 168, 172, 105/175 R, 176, 157 R, 182 R, 138, 224.1, 224.06

[56] References Cited

U.S. PATENT DOCUMENTS

| | | | |
|---|---|---|---|
| 3,789,770 | 2/1974 | List | 105/168 |
| 3,862,606 | 1/1975 | Scales | 105/167 |
| 4,003,316 | 1/1977 | Monselle | 105/167 |
| 4,064,809 | 12/1977 | Mulcahy | 105/167 |
| 4,067,262 | 1/1978 | Scheffel | 105/168 |
| 4,258,629 | 3/1981 | Jackson et al. | 105/167 |
| 4,628,824 | 12/1986 | Goding et al. | 105/136 |
| 4,648,326 | 3/1987 | Jackson | 105/168 |
| 4,679,506 | 7/1987 | Goding et al. | 105/136 |
| 4,679,507 | 7/1987 | Rassaian | 105/136 |

FOREIGN PATENT DOCUMENTS 1261896 1/1972 United Kingdom .

*Primary Examiner*—Joseph F. Peters, Jr.
*Assistant Examiner*—Edwin L. Swinehart
*Attorney, Agent, or Firm*—Robert J. Outland

[57] ABSTRACT

A railway locomotive structure has a stabilized self steering bolsterless and pedestalless powered railway truck with a pivotable carbody beam connecting the truck frame with the carbody for low axle weight transfer and supplemental stabilizers in the form of rubber cushions connected with axle steering beams to aid stability in the steering action, particularly during straight ahead running. Hydraulic or friction damping of the suspensions and steering mechanism are also disclosed.

11 Claims, 2 Drawing Sheets

RAILWAY LOCOMOTIVE AND STABILIZED SELF STEERING TRUCK THEREFOR

TECHNICAL FIELD

This invention relates to railway vehicles and self steering trucks therefore. More particularly the invention relates to powered self steering trucks for railway locomotives and, in particular embodiments, to stabilizing means for such trucks.

BACKGROUND

Our prior U.S. Pat. No. 4,628,824, issued Dec. 16, 1986 to the assignee of the present invention, discloses arrangements of self steering multiple axle railway trucks particularly adapted for self powered locomotive application. The trucks utilize novel force transmitting linkage arrangements between the axles and the truck frames that incorporate traction rods and one or more steering beams to permit self steering of the powered end axles of the trucks. While this patent illustrates the application of such a linkage to a bolster type locomotive truck, it recognizes that similar arrangements can be applied to so called bolsterless truck designs as well and, in addition, to both powered and unpowered railway vehicle trucks.

Copending U.S. Pat. application Ser. No. 800,321 filed Nov. 21, 1985, now U.S. Pat. No. 4,679,506, discloses the application of a similar steering linkage to a locomotive truck of differing design. Additional applicable features of pedestalless axle journals having separable spring supports and traction motor mounted brake mechanisms are also shown.

SUMMARY OF THE INVENTION

The present invention provides for railway locomotive vehicles and the like, self steering railway trucks having some of the features of the previously indicated patent and patent application and providing, in addition, certain other new and improved features. Among these are a bolsterless design having a laterally resilient secondary suspension that provides a centering force while allowing yawing of the truck frame, a secondary frame to carbody linkage with a low mounted carbody beam for weight transfer control, and resilient stabilizers acting to supplementally aid centering of the axle steering linkage to better maintain centered operation on straight track.

These and other features and advantages of the invention will be more fully understood from the following description of a selected embodiment of the invention taken together with the accompanying drawings.

BRIEF DRAWING DESCRIPTION

DETAILED DESCRIPTION

Figure 1:
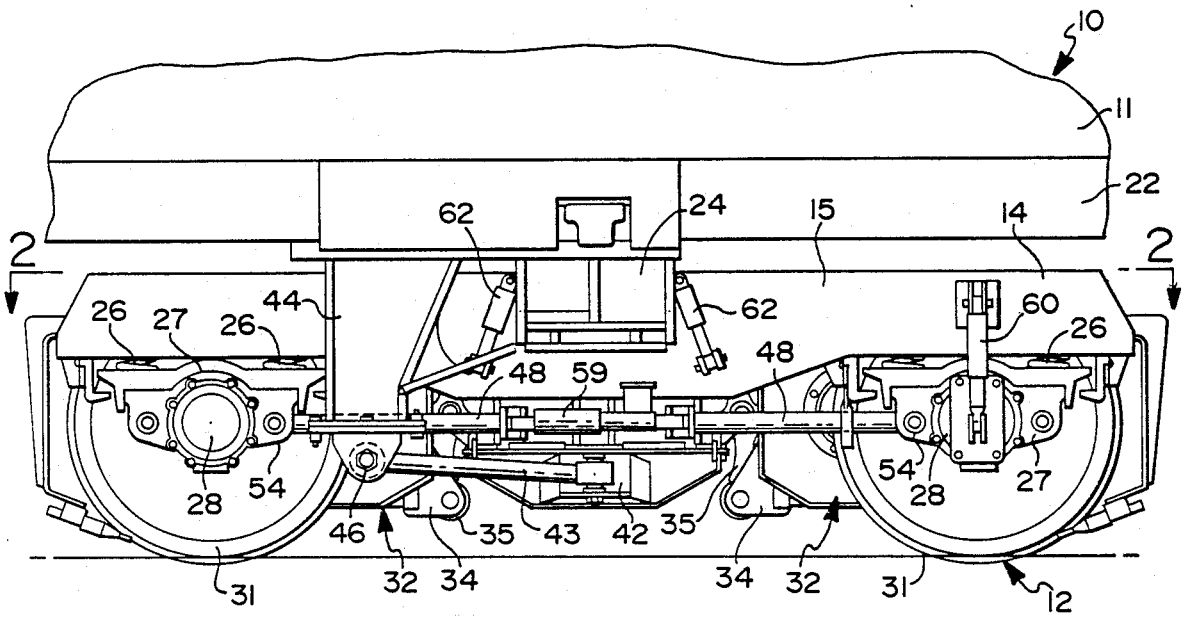
FIG. 1 is a fragmentary side view of a railway locomotive having an associated two axle truck in accordance with the invention.
Figure 2:
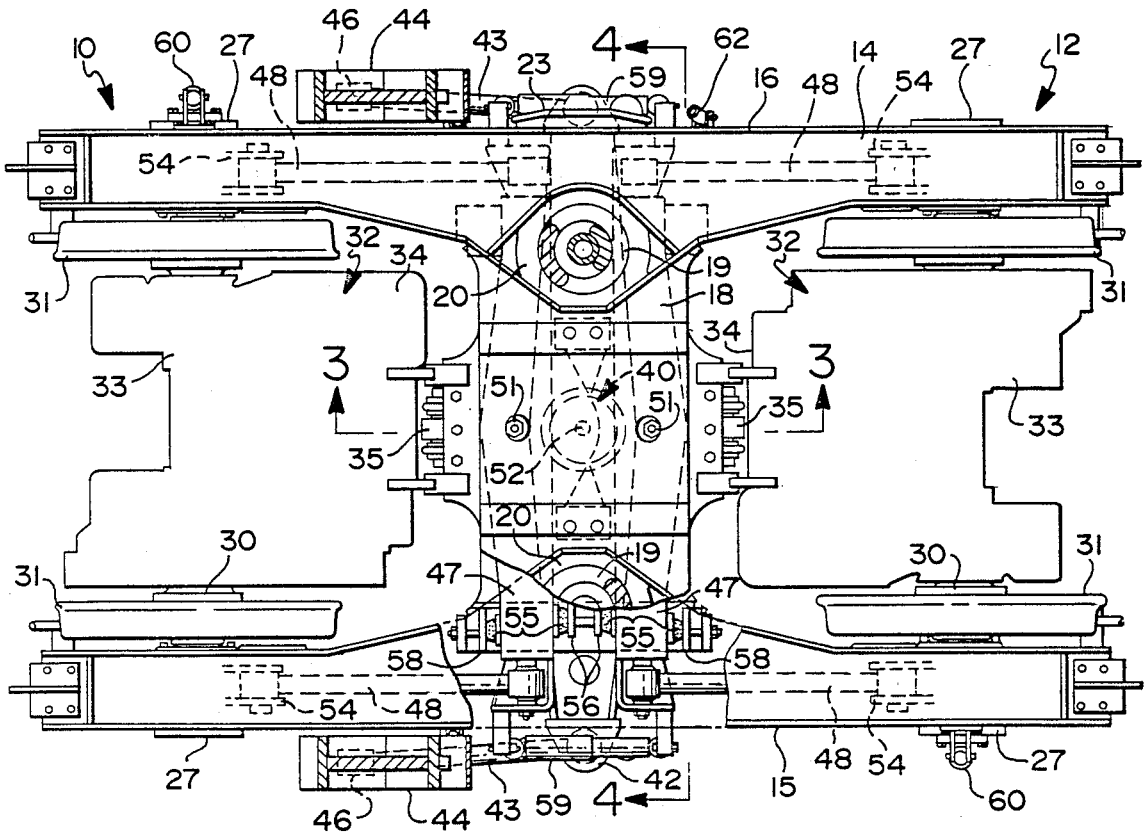
FIG. 2 is a top view of the truck from the plane indicated by the line 2—2 of FIG. 1.
Figure 3:
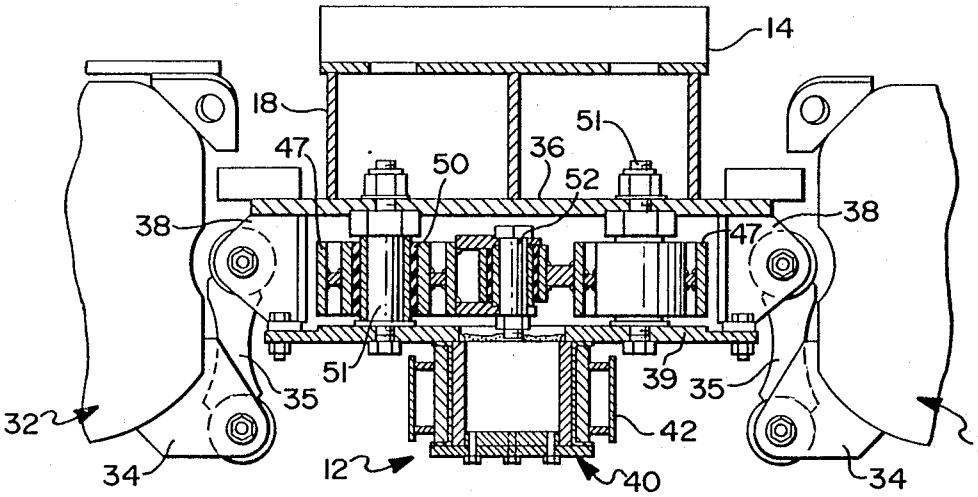
FIG. 3 is a longitudinal cross-sectional view of the central portion of the frame and linkage from the plane indicated by the line 3—3 of FIG. 2
Figure 4:
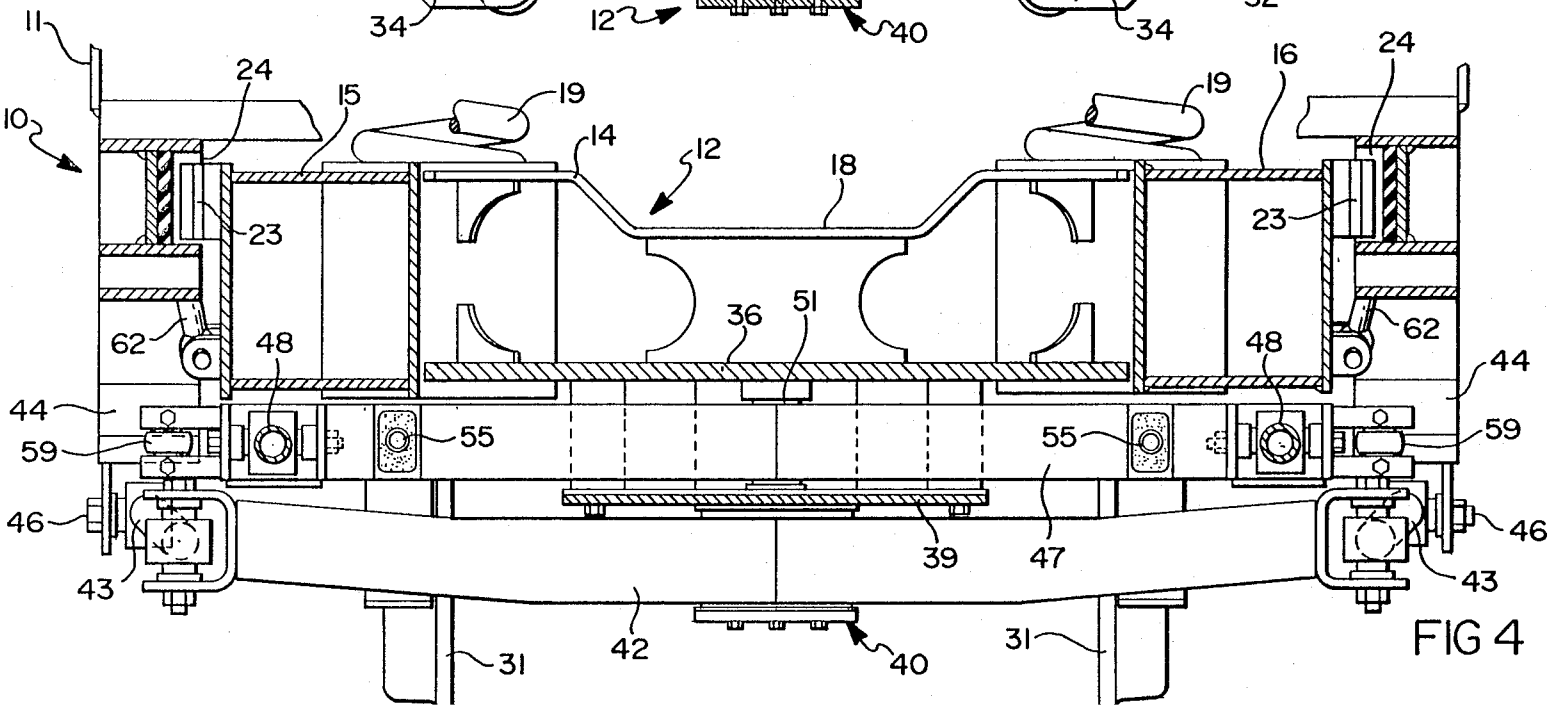
FIG. 4 is a transverse cross-sectional view of the locomotive and truck from the plane indicated by the line 4—4 of FIG. 2.

Referring now to the drawings in detail, numeral 10 generally indicates a railway locomotive having a carbody 11 supported adjacent to one end by a powered self steering railway truck generally indicated by numeral 12.

The truck 12 includes a frame 14 having a pair of generally parallel laterally spaced longitudinally extending side frames 15, 16 interconnected laterally by a central transom 18. Triple coil springs 19 carried in pockets 20, formed in the transom at its juncture with each of the side frames, are received in spring seats, not shown, on the underframe 22 of the carbody. The springs 19 form a secondary suspension supporting the carbody on the truck frame. They are relatively stiff for vertical movement of the carbody relative to the truck frame while allowing resilient lateral motion to accommodate limited lateral movement of the carbody as well as yawing or turning movements of the truck frame under the carbody. Lateral stop plates 23 are provided on the outer sides of the side frames opposite the transom to engage carbody lateral stops 24 depending from the carbody underframe 22 to limit lateral motion of the truckframe underneath the carbody.

Adjacent their ends, the truck side frames 15, 16 are supported on primary suspension means comprising coil springs 26. These are carried by spring seat and bearing adapter assemblies 27, which may be of the separable type described in the previously mentioned U.S. Pat. No. 4,679,506. The assembles 27 are mounted on journal bearing boxes 28 which are carried on the ends of longitudinally spaced and laterally extending axles 30, each carried by a pair of rail engaging wheels 31.

The springs 26 provide relatively soft suspension means for relative vertical motions of the bearing boxes and their associated wheel and axle assemblies relative to the truck frame. In addition, the coil springs 26 provide resilient centering forces that allow limited lateral and longitudinal displacement of the bearing boxes relative to their nominal positions under the truck frame. The springs also provide inherent restoring forces urging the axle boxes to their nominal positions wherein the axles are disposed laterally in parallel relationship, with the wheels aligned for straight ahead running on straight track.

Lateral stops, not shown, are provided between the bearing boxes 28 or the adapter assemblies 27 and the truck frame to limit lateral motion of the wheel and axle assemblies to a predetermined amount. It should be understood that rubber or other suitable alternative resilient suspension means or devices could be substituted for any of the primary or secondary coil spring suspension means illustrated if desired.

For powering the wheel and axle assemblies to drive the locomotive, the truck 12 is provided with a pair of traction motors 32. Each motor has an outer end 33 supported by conventional bearing means on one of the axles 30. An inner end 34 is supported on a rubber cushioned hanger or link 35 by means provided on the longitudinal opposite sides of the transom 18.

In accordance with the invention, the truck frame transom includes a supporting main plate 36 from which depend integral ears 38 thar carry the upper ends of the traction motor supporting links 35. Assembled to this structure is a lower plate 39 carried by the ears 38 and supporting, centrally of the truck, a main beam pivot assembly 40.

The pivot assembly 40 is utilized to connect the truck frame with the carbody for the carrying of longitudinal traction and braking forces therebetween. This is accomplished by a force transmitting linkage comprising a laterally extending main or carbody beam 42 and a pair of connecting rods 43. The carbody beam 42 is pivotably mounted at its center on the pivot assembly 40 and is connected at its ends, outboard of the truck frame, with the longitudinally extending connecting rods 43. These connect the ends of the carbody beam for each truck with stanchions 44. These depend from opposite sides of the carbody underframe 22 to connecting points 46 at a level below the axles and at approximately the level of the carbody beam 42 so as to maintain the connecting rods 43 in generally longitudinal orientation.

This main carbody linkage, comprising carbody beam 42 and connecting rods 43, provides for yawing or turning motions of the truck frame relative to the carbody about the pivot assembly 40 while carrying traction and braking forces from the frame to the carbody at a low level so as to minimize weight shift between the axles.

To provide for limited self steering action of the wheel and axle assemblies in a manner similar to that of the previously mentioned U.S. Pat. No. 4,628,824, the ends of the axles are connected with the truck frame through steering linkages. These are made up for each axle of a steering beam 47 and a pair of traction rods 48.

The steering beams are pivotably mounted by rubber bushings 50 on pivot pins 51 fixed between the main and lower plates 36, 38 of the transom carried structure. The pins 51 are equally longitudinally spaced fore and aft of the center of the main pivot assembly located therebelow. A rubber bushed pin connection 52 is utilized to interconnect the steering beams 47 intermediate their pivots to require substantially equal and opposite pivoting action of the steering beams when in operation. The traction rods 48 are connected by swivel connections or rubber bushings between the ends of the respective steering beams 47 and the longitudinally adjacent ears 54 of the associated bearing adapter assemblies 27.

The equal and opposite steering action of the axles mandated by the described linkage is accomplished in substantially the same manner as that described in the referenced U.S. Pat. No. 4,628,824. The flexibility of the rubber bushed pin connection 52 accommodates the slightly varying center distances from the pin connection 52 to the pivot pins 51 during steering actions and obviates the need for the connecting link illustrated in the prior patent. Such a link or other connecting mechanism could, of course, be utilized if desired. It should be noted that the steering beams 47 and their associated longitudinally extending traction rods 48 are disposed substantially at or near axle height and slightly above the level of the main carbody beam 42 and its associated connecting rods 43.

Further in accordance with the invention, the steering action of the axles in tne truck assembly is stabilized and straight ahead running motion of the truck is improved by the addition of yieldable stabilizers in the form of resilient rubber cushions 55, or the like, mounted adjacent the ends of the steering beams. The stabilizers 55 are engageable with inner and outer bumpers 56, 58 respectively, during turning motion of the axles.

The rubber cushions, or stabilizers, may be set to lightly engage their respective bumpers when the axles are in their central straight ahead running condition. Alternatively, there may be provided a slight clearance so that the stabilizers engage their bumpers only when a slight pivoting of the bearing beams occurs during a small or initial self steering action of the axles. In either event, the stabilizers 55 apply a supplemental restoring force on the steering mechanism in addition to the primary restoring force provided by the primary suspension springs 26. In addition, a certain amount of natural damping is provided by the rubber cushion stabilizers 55.

This supplemental restoring force and the additional damping both combine to reduce or obviate oscillations or hunting of the self steering mechanism and provide additional stabilizing to assist the self steering forces to maintain accurate tracking when in the straight ahead condition by opposing erratic or unbalanced friction forces on the wheels which may develop in operation. In addition, further damping of the steering action may be provided by the connecting of friction or hydraulic absorbers 59 between the ends of the steering beams.

If desired, the primary and secondary suspensions may also be damped by the addition of suitable absorbers 60 between certain of the axle ends and the truck frame and additional absorbers 62 between the truck frame and the carbody supporting structure for the lateral stops 24 depending from the carbody underframe. In this manner, a highly stabilized and improved powered railway locomotive truck of pedestalless and bolsterless design is constructed to provide stable self steering action for curving and straight line running on conventional railway rights of way.

While the invention has oeen described by reference to a preferred embodiment, it should be understood that numerous changes could be made within the spirit and scope of the inventive concepts described. For example, it should be recognized that the described features of the invention can be applied, where appropriate to the end axles of railway trucks having more than two axles, as well as to dual axle trucks constructed differently than the described embodiment. Accordingly it is intended that the invention not be limited to the disclosed embodiments, but that it have the full scope permitted by the language of the following claims.

The embodiments of the invention in which an exclusive property or privilege is claimed are defined as follows:

1. A railway locomotive comprising a carbody supported by a self steering truck including a pair of wheel supported axles, a frame carried by said axles through resilient suspension means nominaliy urging the axles into centered positions for motion along straight track but permitting yawing for movement along curved track, traction motors drivingly connected with the axles for driving the locomotive wheels, force transmitting linkage connecting the axles with the frame and including a lateral steering beam connected with at least one of the axles and having a center pivotally connected with the frame and otherwise free from connection with the carbody to allow self steering of its connected axle while carrying longitudinal forces between it and the frame, second force transmitting linkage including a lateral carbody beam connected with the carbody and having a center pivotally connected with the frame to allow yawing of the frame under the carbody, said carbody beam and its connections with the frame and the carbody being at a level below that of the steering beam and its connected axle to minimize load transfer between the axles during operation

2. A railway locomotive as in claim 1 wherein said traction motors are supported by the axles and the truck frame and are steerable with their connected axles.

3. A railway locomotive as in claim 2 and further comprising resilient secondary suspension means on the truck frame and adapted to support thereon said associated carbody, said secondary suspension means being sufficiently laterally yieldable to allow said yawing of the frame under the caroody.

4. A railway locomotive as in claim 3 and further comprising resilient stabilizers operatively acting between the frame and the axles to supplementally urge the axles toward their centered positions at least when their yawing exceeds a predetermined degree, said stabilizers being sufficiently yieldable to allow predetermined yawing action of the axles under self-steering forces developed during operation on curved track but sufficiently stiff to limit yawing action of the axles due to unstable hunting forces developed during operation on straight track.

5. A railway vehicle comprising a carbody supported by a self steering truck including a pair of wheel supported axles, a frame carried by said axles through resilient suspension means nominally urging the axles into centered positions for motion along straight track but permitting yawing for movement along curved track, force transmitting linkage connecting the axles with the frame and including a lateral steering beam connected with at least one ot the axles and having a center pivotally connected with the frame and otherwise free from connection with the carbody to allow self steering of its connected axle while carrying longitudinal forces between it and the frame, second force transmitting linkage including a lateral carbody beam connected with the carbody and having a center pivotally connected with the frame to allow yawing of the frame under the carbody, said carbody beam and its connections with the frame and the carbody being at a level below that of the steering beam and its connected axle to minimize load transfer between the axles during operation.

6. A railway vehicle as in claim 5 and further comprising resilient secondary suspension means on the truck frame and adapted to support thereon said associated carbody, said secondary suspension means being sufficiently laterally yieldable to allow said yawing of the frame under the carbody.

7. A railway vehicle as in claim 6 and further comprising resilient stabilizers operatively acting between the frame and the axles to supplementally urge the axles toward their centered positions at least when their yawing exceeds a predetermined degree, said stabilizers being sufficiently yieldable to allow predetermined yawing action of the axles under self steering forces developed during operation on curved track but sufficiently stiff to limit yawing action of the axles due to unstable hunting forces developed during operation on straight track.

8. A self steering railway truck comprising a pair of wheel supported axles, a frame carried by said axles through resilient suspension means nominally urging the axles into centered positions for motion along straight track but permitting yawing for movement along curved track, force transmitting linkage connecting the axles with the frame and otherwise free from connection with an associated carbody to allow self steering of the axles while carrying longitudinal forces between the axles and the frame, and resilient stabilizers disposed between the force transmitting linkage and the frame and operatively acting between the frame and the axles to supplementally urge the axles toward their centered positions at least when their yawing exceeds a predetermined degree, said stabilizers being sufficiently yieldable to allow predetermined yawing action of the axles under under curving forces developed during operation on curved track but sufficiently stiff to limit yawing action of the axles due to unstable hunting forces developed during operation on straight track.

9. A self steering railway truck as in claim 8 wherein said stabilizers comprise resilient stops.

10. A self steering railway truck as in claim 8 wherein said force transmitting linkage include a lateral steering beam having a center pivotally connected with the frame and said stabilizers are disposed between the steering beam and the frame.

11. A self steering railway truck as in claim 10 wherein said stabilizers comprise rubberlike cushions.

* * * * *